US005388556A

United States Patent [19]

Angus et al.

[11] Patent Number: 5,388,556

[45] Date of Patent: Feb. 14, 1995

[54] INTERNAL COMBUSTION ENGINE HAVING FLEXIBLE BLOCK AND FLEXIBLE OIL PAN

[75] Inventors: William G. Angus, Peoria, Ill.; Terry L. Beranek; Joseph R. Brinker, both of W. Lafayette, Ind.

[73] Assignee: Caterpillar Inc., Peoria, Ill.

[21] Appl. No.: 224,847

[22] Filed: Apr. 8, 1994

[51] Int. Cl.[6] ..... F02F 7/00

[52] U.S. Cl. ..... 123/195 C; 123/195 H

[58] Field of Search ..... 123/195 C, 195 H; 184/106

[56] References Cited

U.S. PATENT DOCUMENTS 4,369,744 1/1983 Kubozuka et al. ..... 123/195 C 4,911,118 3/1990 Kageyama et al. ..... 123/195 C

*Primary Examiner*—Noah P. Kamen

*Attorney, Agent, or Firm*—Frank L. Hart

[57] ABSTRACT

A high horsepower internal combustion engine has an elongated block that is flexible during engine operation and an oil pan having sidewalls and is connectable to the block and flexible therewith. The oil pan has a plurality of baffles that are positioned within the oil pan, connected thereto at spaced apart locations and each have a flexible portion between the connecting location and the body of the baffle.

8 Claims, 1 Drawing Sheet

INTERNAL COMBUSTION ENGINE HAVING FLEXIBLE BLOCK AND FLEXIBLE OIL PAN

TECHNICAL FIELD

The present invention relates to an internal combustion engine of high horsepower which has a flexible block and a flexible oil pan.

BACKGROUND ART

It was discovered that internal combustion engines of high horsepower could be made more accessible for workover and repair if the stiffening members on the block were not present and the engine block could flex and move during operation of the engine. This, however, produced another problem. As the engine flexed and moved, the oil pan likewise flexed and moved. Although the oil pan retained its integrity and seal during such movement, it was discovered that the rigid baffles in the oil pan sometimes broke loose from their connection.

These problems are significant on large industrial internal combustion engines which sometimes have a block whose length exceeds 2500 mm.

The present invention is directed to overcome one or more of the problems as set forth above.

DISCLOSURE OF THE INVENTION

A high horsepower internal combustion engine has an elongated block that is flexible during engine operation. The oil pan has sidewalls and is connectable to the block and flexible therewith.

A plurality of baffles are positioned within and connected to the oil pan. The baffles each have a body and opposed side portions. Each baffle is connected at spaced apart locations on opposed baffle side portions to a respective side of the oil pan. At least one of the side portions of each baffle have a flexible portion of curvilinear cross sectional configuration. The flexible portion is located between the connecting location of the baffle to the respective oil pan sidewall and the baffle body.

BEST MODE FOR CARRYING OUT THE INVENTION

Figure 1:
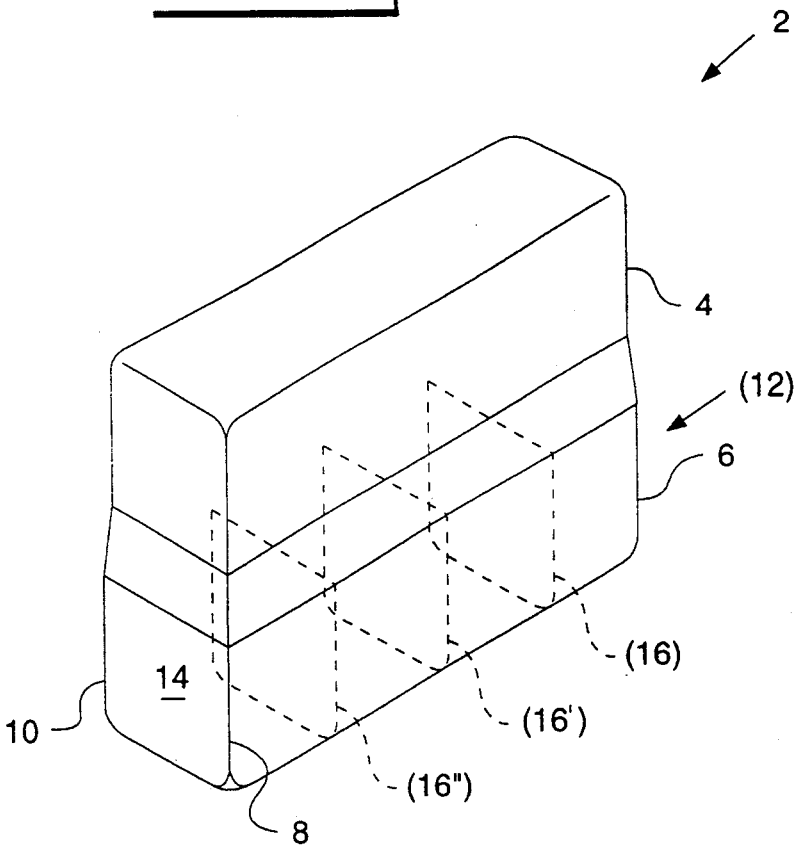
FIG. 1 is a diagrammatic view of a high horsepower internal combustion engine having a block and an oil pan of this invention.

Referring to FIG. 1, a high horsepower internal combustion engine 2, for example an engine having 6000 HP, has an elongated block 4 that is flexible during engine operation. An example of such engine 2 is a Model No. 3612 manufactured by Caterpillar Inc. of Peoria, Ill. This engine 2 has a block 4 whose length is 2900 mm.

The oil pan 6 of the engine 2, has sidewalls 8,10 and end walls 12,14 that are connectable to the engine block 4, as is known in the art. Also, as is likewise known in the art, the oil pan 6 contains a plurality of baffles 16,16',16'' that are positioned within the oil pan 6 and connected at spaced apart locations on opposed sides to respective sidewalls 8,10 of the oil pan 6.

Figure 2:
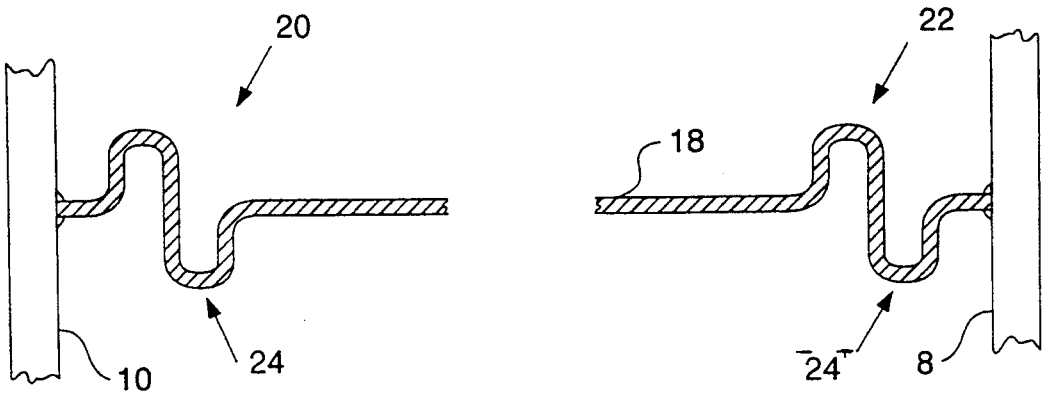
FIG. 2 is a diagrammatic partial view of the baffles of this invention.

Referring to FIG. 2, where a single baffle 16 will be described in detail for purposes of brevity, the baffle 16 has a body 18 and opposed side portions 20,22. At least one of the side portions 20, preferably both of said side portions 20,22 have a flexible portion 24,24' of curvilinear cross sectional configuration. The flexible portions 24,24' are located between a respective connecting location of the baffle 16 to a respective oil pan sidewall 8/10 and the baffle body 18.

Each flexible portion 24, 24' of each baffle is preferably of a general "S" cross sectional configuration and extends across the entire length of the respective baffle side portion 20,22. The body of each baffle 16 is generally planer with openings therethrough and defining, with the oil pan 6, other openings for the controlled passage of oil past the baffles, as is well known in the art.

In a preferred embodiment of a baffle 16 of this invention for an oil pan 6 which has a length of about 3315 mm and a width of about 870 mm, the baffle bend radii of the flexible portion is in the range of about 12 mm to about 18 mm. Bend radius of less magnitude are undesirable because flexibility decreases and bend radius of greater magnitude are undesirable because the baffle becomes so flexible it is driven into resonance by the natural frequency of the operating engine. Preferably, for the baffle 16 of an oil pan 6 of this size, each bend radii is about 12 mm and 18 mm. It has also been discovered that where the oil pan 6 has a length greater than about 3000 mm, a width greater than about 850 mm and at least 4 spaced apart baffles connected to the oil pan 6, each baffle 16 preferably shall have first and second flexible portions 24,24' each of general "S" cross sectional configuration and a bend radii of about 12 mm and 18 mm.

Industrial Applicability

In the operation of a high horsepower internal combustion engine having an elongated block that is flexible during engine operation and an oil pan having sidewalls and being connectable to the block and flexible therewith, as the oil pan 6 flexes and moves with the block 4, corresponding movement of the baffles 16,16',16'' is restricted by relative movement of the baffle flexible portions 24 and/or 24'. These flexible portion 24,24' therefore protect the connection locations of the baffles 16,16',16'' to the oil pan side walls 8,10 from forces which tend to separate the connection.

Other aspects, objects and advantages of this invention can be obtained from a study of the drawings, the disclosure and the appended claims.

We claim:

1. In a high horsepower internal combustion engine having an elongated block that is flexible during engine operation and an oil pan having sidewalls and being connectable to the block and flexible therewith, the improvement comprising:

a plurality of baffles each having a body and opposed side portions, each baffle being connected at spaced apart locations on said opposed baffle side portions to a respective side of the oil pan, at least one of said side portions of each baffle having a flexible portion of curvilinear cross sectional configuration located between the connecting location of the baffle to the respective oil pan side and the baffle body.

2. The high horsepower internal combustion engine, as set forth in claim 1, wherein the flexible portion of the baffle is of a general "S" cross sectional configuration.

3. The high horsepower internal combustion engine, as set forth in claim 2, wherein the flexible portion of the baffle side portion extends across the entire length of the baffle side portion.

4. The high horsepower internal combustion engine, as set forth in claim 2, wherein the body of each baffle is generally planer.

5. The high horsepower internal combustion engine, as set forth in claim 2, wherein each side portion of each baffle has a flexible portion of a general "S" cross sectional configuration.

6. The high horsepower internal combustion engine, as set forth in claim 2, wherein the bend radii of the flexible portion is in the range of about 12 mm to about 18 mm.

7. The high horsepower internal combustion engine, as set forth in claim 6, wherein the bend radii of the flexible portion is about 12 mm and 18 mm.

8. The high horsepower internal combustion engine, as set forth in claim 1, wherein the oil pan has a length greater than about 3000 mm, a width greater than about 850 mm, at least 4 spaced apart baffles connected to the oil pan with each baffle having first and second flexible portions, each of general "S" cross sectional configuration and a bend radii of about 12 mm and 18 mm.

* * * * *